US009993865B2

(12) United States Patent
Xiong et al.

(10) Patent No.: US 9,993,865 B2
(45) Date of Patent: Jun. 12, 2018

(54) ALUMINUM ALLOY PRODUCTS FOR MANUFACTURING STRUCTURAL COMPONENTS AND METHOD OF PRODUCING THE SAME

(75) Inventors: Baiqing Xiong, Beijing (CN); Yongan Zhang, Beijing (CN); Baohong Zhu, Beijing (CN); Xiwu Li, Beijing (CN); Zhihui Li, Beijing (CN); Feng Wang, Beijing (CN); Hongwei Liu, Beijing (CN)

(73) Assignee: GRIMAT Engineering Institute Co., Ltd., Beijing (CN)

( * ) Notice: Subject to any disclaimer, the term of this patent is extended or adjusted under 35 U.S.C. 154(b) by 798 days.

(21) Appl. No.: 13/138,129

(22) PCT Filed: Jun. 25, 2010

(86) PCT No.: PCT/CN2010/074529
§ 371 (c)(1),
(2), (4) Date: Jul. 11, 2011

(87) PCT Pub. No.: WO2011/091645
PCT Pub. Date: Aug. 4, 2011

(65) Prior Publication Data

US 2011/0297278 A1 Dec. 8, 2011

(30) Foreign Application Priority Data

Jan. 29, 2010 (CN) ..... 2010 1 0104082

(51) Int. Cl.
*C22C 21/10* (2006.01)
*C22F 1/053* (2006.01)
(Continued)

(52) U.S. Cl.
CPC ..... *B22D 7/005* (2013.01); *B22D 18/04* (2013.01); *B22D 27/02* (2013.01); *B22D 27/08* (2013.01); *C22C 21/10* (2013.01); *C22F 1/053* (2013.01)

(58) Field of Classification Search
CPC ..... C22C 21/10; C22F 1/053
See application file for complete search history.

(56) References Cited

U.S. PATENT DOCUMENTS 6,315,842 B1 11/2001 Shahani et al.
2002/0150498 A1 10/2002 Chakrabarti et al.
(Continued)

FOREIGN PATENT DOCUMENTS

CA 2485524 12/2003
CN 1442501 A 9/2003
(Continued)

OTHER PUBLICATIONS

Office Action dated Apr. 5, 2017 from the Canadian Intellectual Property Office for corresponding Canadian Patent Application No. 2,741,587.
(Continued)

*Primary Examiner* — George Wyszomierski
*Assistant Examiner* — Janelle Morillo
(74) *Attorney, Agent, or Firm* — Walter | Haverfield LLP; D. Peter Hochberg; Sean F. Mellino

(57) ABSTRACT

An aluminum alloy product for manufacturing structural components, made from direct chill casting ingots comprises, based on wt %: Zn 7.5~8.7, Mg 1.1~2.3, Cu 0.5~1.9, Zr 0.03~0.20, the balance being Al, incidental elements and impurities. The levels of Zn, Mg, Cu, and Zr in the aluminum alloy products satisfy the expressions of (a) 10.5≤Zn+Mg+Cu≤11.0; (b) 5.3≤(Zn/Mg)+Cu≤6.0; and (c) (0.24−D/4800)≤Zr≤(0.24−D/5000). D is the minimum length of a line
(Continued)

section connecting any two points on the periphery of the cross section of the ingot and passing through the geometrical center of the cross section. 250 mm≤D≤1000 mm. The aluminum alloy products have a superior combination of strength and damage tolerance, and exhibit homogeneous and consistent performance on the surface, at various depths under the surface, and in the core of the product. A method of producing the aluminum alloy products is also provided.

21 Claims, 3 Drawing Sheets

(51) Int. Cl.

| | |
|---|---|
| ***B22D 7/00*** | (2006.01) |
| ***B22D 18/04*** | (2006.01) |
| ***B22D 27/02*** | (2006.01) |
| ***B22D 27/08*** | (2006.01) |

(56) References Cited

U.S. PATENT DOCUMENTS

| | | | | |
|---|---|---|---|---|
| 2003/0219353 | A1 | 11/2003 | Warner et al. | |
| 2004/0089382 | A1 | 5/2004 | Senkov et al. | |
| 2005/0189044 | A1* | 9/2005 | Benedictus et al. | 148/552 |
| 2006/0083654 | A1 | 4/2006 | Chakrabarti et al. | |
| 2006/0182650 | A1 | 8/2006 | Eberl et al. | |
| 2008/0283163 | A1 | 11/2008 | Bray et al. | |

FOREIGN PATENT DOCUMENTS

| | | | |
|---|---|---|---|
| CN | 1489637 | A | 4/2004 |
| CN | 1780926 | A | 5/2006 |
| CN | 101407876 | A | 4/2009 |
| JP | S 6013047 | A | 1/1985 |
| JP | 60234955 | A | 11/1985 |
| JP | S 63297543 | A | 12/1988 |
| JP | H 03188238 | A | 8/1991 |
| JP | H 08295976 | A | 11/1996 |
| JP | 2006522871 | A | 10/2006 |
| JP | 2007100157 | A | 4/2007 |

OTHER PUBLICATIONS

Office Action dated May 30, 2016 from the Canadian Intellectual Property Office for corresponding Canadian Patent Application No. 2,741,587.

CA office action & examination search report dated Dec. 16, 2014; corresponding app. No. CA2741587.

* cited by examiner

ALUMINUM ALLOY PRODUCTS FOR MANUFACTURING STRUCTURAL COMPONENTS AND METHOD OF PRODUCING THE SAME

CROSS-REFERENCE TO RELATED APPLICATIONS

This application is a National Stage application of International Application No. PCT/CN2010/074529, filed on Jun. 25, 2010, which claims priority of Chinese application number 201010104082.6, filed on Jan. 29, 2010, both of which are incorporated herein by reference in their entireties.

BACKGROUND OF THE INVENTION

Field of the Invention

The present invention relates to aluminum alloys (also known as Al alloys), especially to 7xxx series aluminum alloys (Al—Zn—Mg—Cu based aluminum alloys) as designated by the International Aluminum Association. In particular, the present invention relates to large thickness (e.g., from 30~360 mm) products made from 7xxx series aluminum alloys. Although the present invention is directed to large thickness forged product shapes and rolled plate product forms in the most cases, it can also be used for extrusions and cast products having a large thickness entirely or locally.

Description of the Prior Art

In the modern aerospace manufacturing, with the increasing requirements of integrated flight performance, payload fuel consumption, service life, and reliability of aircrafts, large integral aluminum alloy structural components are widely used in aircrafts more and more. For instance, in the design and manufacturing of junctions of the wing and the body of an aircraft, using an integral wing-body built-up component of wing and body of an aircraft made from a large-scale aluminum alloy product having a homogeneous composition and prepared by a numerical control milling process, instead of a conventional combination built-up component assembled with a plurality of separate aluminum alloy parts having various composition, not only can reduce substantially the weight of components and increase the reliability during service life, but also can reduce substantially the procedures of assembling components and decrease the comprehensive costs for manufacturing an aircraft.

However, such advanced design and manufacturing method leads to a highly harsh requirement for the comprehensive performance of relevant aluminum alloy products.

As well known in the field of aircraft manufacturing, with regard to materials of making the face surface of the wing or the built-up structure of wing and body of an aircraft, it is commonly desirable that they possess an optimal compressive yield strength, as well an acceptable damage tolerance property; whereas with regard to materials of making the back surface of the wing or the built-up structure of wing and body of an aircraft, it is commonly desirable that they possess an optimal damage tolerance property, as well as an acceptable tensile yield strength. In a conventional combinational structure, the aforesaid object can be achieved by assembling a plurality of aluminum alloy parts having various compositions. As an example, when designing and selecting the materials of making the face surface, it is preferable to use aluminum alloys having a higher level of compressive yield strength and an acceptable damage tolerance property, such as, 7150, 7055, 7449 alloys or the like; and when designing and selecting the materials of making the back surface, it is preferable to use aluminum alloys having an acceptable tensile yield strength and an optimal damage tolerance property, e.g., 2324, 2524 alloys, or the like. However, (1) if the aforesaid structure is designed as an integral structure, the single alloy product as used should possess both the optimal tensile and compressive yield strengths and the optimal damage tolerance property, namely, possess the so-called "optimal combination of properties"; and (3) some integral components tend to have a greater local thickness, whereby causing that the aluminum alloy products for making these integral components should have a great thickness of, e.g., 30 mm or greater, or even up to 360 mm. For ensuring the property consistency of various sites of the integral component, it is desired that various sites within the aluminum alloy products should possess highly homogeneous properties.

Through testing the over-all properties, it has been found that some conventional high-strength and high-toughness aluminum alloys broadly used in the field of aircraft manufacture cannot satisfy the before identified requirements. For instance, 7050, 7150 alloys, etc., are well known in the field as the aluminum alloys having a good balance of various properties. Products made from these alloys having a thickness of 20~80 mm can exhibit good over-all properties in both the surface and the core, as well as acceptable differences between the surface and the core; but product of these alloys having a thickness of up to 150 mm represent a yield strength of the core at least 10% lower than the yield strength of the surface and remarkable differences of elongation and fracture toughness, even though they still can maintain the good over-all properties in the surface. Moreover, 7055, 7449 alloys, etc., are well known in the art as wrought high-strength aluminum alloys. Products made from these alloys having a thickness of 20~60 mm can represent desirably a high strength in both the surface and the core, as well as acceptable differences between the surface and the core; but product of these alloys having a thickness of up to 100 mm represent a yield strength, elongation, fracture toughness, threshold of fatigue fracture, corrosive nature of the core at least 10%~25% lower than those of the surface, even though they still can maintain substantially a high strength and other over-all properties in the surface. A well-established principle is that the designers select materials on the basis of the minimal guaranteed properties of the materials during the designing of the structure of aircraft. According to this principle, when conventional alloys including 7050, 7150, 7055, 7449, or the like are processed to products having a smaller thickness of e.g., 80 mm or below, there is a good comprehensive performance consistency between the surface and the core, and the minimal ensurable property (typically, the core properties) can satisfy the requirements of manufacturing some structural components having a higher load-bearing; however, if these alloys are processed to large thickness products, the core properties deteriorate remarkably, and the minimal ensurable properties of the products have become incapable of satisfying the requirements of manufacturing some structural components having a higher load-bearing. Furthermore, products made from 7xxx series aluminum alloys represents too large differences between the surface and the core, whereby resulting in some unexpected problems during subsequent processing, such as, a relatively high residual internal stress, as well as the hardness of establishment and operation of subsequent milling process. It is undesired for the designers of aircraft.

A great number of research results indicate that the property differences between the surface and the core of large thickness products made from 7xxx series aluminum alloys are primarily due to the quenching process after the solution heat treatment of the alloys. FIG. 1 shows the curve of quenching of large thickness products made from 7xxx series aluminum alloys, from which it can be seen that there are remarkable differences between the quenching processes, as well as the cooling rates of the sites at different thicknesses of the products under certain conditions; in particular, the quenching rate of the core of the product is much lower than that of the surface. FIG. 2 shows the dimension and distribution of the second phase formed by the decomposition of supersaturated solid solution of alloys during the quenching, from which it can be seen that the supersaturated solid solution of alloys is decomposed due to the lower quenching rate around the core of the product, and a large amount of solute elements are precipitated and grown to relatively coarser quench-precipitated phase. The generation of such coarse quench-precipitated phase not only reduce the degree of supersaturation of the solute element within the matrix of the core of alloy product so as to reduce the amount of the precipitation-strengthened phase formed during the subsequent aging treatment and deteriorate the strength property at these sites, but also is likely to become the origin of crack initiation and micro-area corrosion so as to deteriorate other properties of the site, for example, elongation, fracture toughness, fatigue property, corrosion-resistance, and the like. Meanwhile, it can be also seen that solute elements are less or hardly precipitated in proximity of the surface of product due to the relatively higher quenching rate, and the supersaturation of the solute elements within the matrix, thereby facilitating the formation of adequate, fine, suitably distributed, precipitation-strengthened phase during the subsequent aging process, such that the desired good comprehensive performance of alloys can be maintained in proximity of the surface of products.

More intensive research results indicate that the affect of the quenching rate on the decomposition behavior of supersaturated solid solution of 7xxx series aluminum alloys are primarily due to two aspects as described below.

The first aspect is the so-called "stability of supersaturated solid solution".

In 7xxx series aluminum alloys, it is well known that Zn, Mg, and Cu are primary alloying elements. The addition of Zn and Mg is mainly for the purpose of forming a precipitation-strengthened phase having a chemical constitution of $MgZn_2$ and in a coherence relation with the matrix in the alloys. Furthermore, on the one hand, the addition of Cu is mainly for the purpose of improving the corrosion resistance of alloys by modifying the electrode potential of the alloys by solutionizing Cu in the matrix or the precipitated phase; and on the other hand, the presence of Cu can accelerate the formation of the precipitated phase and enhance the stability at an elevated temperature. When the level of Cu exceeds the solid solubility limit thereof in the matrix and the precipitated phase, a precipitation-strengthened phase having a chemical constitution of $Al_2Cu$ and other Cu-enriched ternary phase and quaternary phase can be formed and produce an additionally strengthening effect. For years, persons skilled in the art make an effort to enhance the strength, toughness and corrosion resistance of 7xxx series aluminum alloys; and up to now a full set of theories and methods for controlling the level range of primary alloying elements Zn, Mg, and Cu have been established, on the basis of which a series of 7xxx series aluminum alloys having various properties and characteristics have been developed. However, in recent years, it have been found that some alloys prepared at a certain ratio of three primary alloying elements Zn, Mg, and Cu within the level range of conventional 7xxx series aluminum alloys can form, during the quenching process subsequent to the solution heat treatment, a supersaturated solid solution exhibiting a good stability under slow cooling conditions, whereas alloys prepared with other ratios will form a supersaturated solid solution which is likely to be decomposed under slow cooling conditions. Summarized on the basis of observation, even though inherent microscopic mechanism is not completely known, it have been found that the stability of supersaturated solid solution under various cooling rate conditions are not sensitive to the change of Zn level in a relatively broad range, whereas are highly sensitive to the change of Cu level. In particular, excessive Cu is likely to cause a sharp falling of the stability of supersaturated solid solution of alloys under a certain quenching rate conditions.

The second aspect is the so-called "induced precipitation phenomenon".

7xxx series aluminum alloys comprise inevitably impurity elements, such as, Fe, Si, or the like, and thus Fe-enriched phase, Si-enriched phase, etc. will be formed during the solidifying of alloys. Meanwhile, for the purpose of controlling the dimension of casting crystalline grains of the alloys and the growth of grains during homogenization and for inhibiting the occurrence of recrystallization during the thermal distortion processing and the solution heat treatment, a plurality of trace alloying elements (e.g., Ti, Cr, Mn, Zr, Sc, Hf, and the like) are added into the alloys to form some second fine phases capable of representing a pinning effect on the crystal boundary during solidifying of alloys, or precipitating some fine dispersed phases capable of both representing a pinning effect on the crystal boundary and contributing to a strengthening effect during homogenization of alloys. However, there are research results indicating that various second phases formed during solidifying of alloys, or even some dispersed phases precipitated during homogenization treatment of alloys are commonly in mismatching relation with the crystal lattice of the matrix, and thereby the second phases in mismatching relation with the lattice of matrix are likely to serve as the nuclei of "inducing" heterogeneous core of quench-precipitation phase. The micrographs as shown in FIG. 3 illustrate the preferential precipitation of the quench-precipitation phase at the sites of the aforesaid second phases in mismatching relation with the lattice of the matrix.

In recent years, the before described problems have caught extensive attention of many research institutions and companies. On the basis of abundant laboratory research in combination of theoretical calculation and analysis, a series of high performance 7xxx series aluminum alloy materials which exhibit good over-all properties and are relatively less affected in terms of various properties by the change of product thickness (i.e., the so-called "low quench sensitivity") have been developed by optimizing the components of alloys, combined with optimizing the preparing, molding, and heat-treating processes thereof.

For instance, (1) CN1489637A, which is submitted by Alcoa Inc. (a U.S. company) and published in 2004, discloses a low quench sensitivity, high-strength and high-toughness aluminum alloy adapted for the production of large thickness structural components, consisting essentially of: Zn 6-10 wt %, Mg 1.2-1.9 wt %, Cu 1.2-1.9 wt %, Zr≤0.4 wt %, Sc≤0.4 wt %, Hf≤0.3 wt %, Ti≤0.06 wt %, Ca≤0.03 wt %, Sr≤0.03 wt %, Be≤0.002 wt %, Mn≤0.3 wt %, Fe≤0.25 wt %, Si≤0.25 wt %, and balance Al. Also, the aluminum alloy preferably comprises Zn 6.4-9.5 wt %, Mg 1.3-1.7 wt %, Cu 1.3-1.9 wt %, Zr 0.05-0.2 wt %, wherein Mg wt %≤(Cu wt %+0.3 wt %). As listed in the embodiments of CN1489637A, under T7 "over-aged" conditions, the yield strength/fracture toughness in the longitudinal (L-) direction of the core of a plate product made from typical alloys may be up to 516 MPa/36.6 MPa·$m^{1/2}$ when the plate product has a thickness of up to 152 mm; and the process of heat treatment may be adjusted to increase the yield strength and decrease the fracture toughness, or to decrease the yield strength and increase the fracture toughness. Moreover, the yield strength of the core of products may be up to 489 MPa (in the L-direction)/486 MPa (in the LT-direction) when the forging piece made from typical alloys have a thickness of 178 mm. In that case, the products may exhibit much better elongation, fatigue, as well stress corrosion resistance and exfoliation corrosion properties, compared with those having a similarly greater thickness and made from conventional alloys 7050, 7150, 7055, and the like, and exhibit a superior balance of various properties and low quench sensitivity.

(2) CN1780926A, which is submitted by Corus Aluminum Walzprod GmbH (a German company) and published on 2006, discloses a high-strength and high-toughness aluminum alloy having superior balance of various properties, consisting essentially of: Zn 6.5-9.5 wt %, Mg 1.2-2.2 wt %, Cu 1.0-1.9 wt %, Zr≤0.5 wt %, Sc≤0.7 wt %, Cr≤0.4 wt %, Hf≤0.3 wt %, Ti≤0.4 wt %, V≤0.4 wt %, Mn≤0.8 wt %, Fe≤0.3 wt %, Si≤0.2 wt %, other impurities or incidental elements each ≤0.05 wt %, total ≤0.15 wt %, and balance Al; preferably, (0.9 Mg-0.6)≤Cu≤(0.9 Mg+0.05). As listed in the embodiments of CN1780926A, under T7 "over-aged" conditions (including T76 and T74), the ultimate tensile strength/yield strength/elongation/fracture toughness/exfoliation corrosion properties at the site of ¼ thickness of the products can be up to 523 MPa/494 MPa/10.5%/39 MPa·$m^{1/2}$/EA, when the plate products made from typical alloys have a thickness of up to 150 mm, and the process of heat treatment may be adjusted to increase the yield strength and decrease the elongation and fracture toughness, or to decrease the yield strength and increase the elongation and fracture toughness. In that case, the products may exhibit a superior balance of various properties and a low quench sensitivity.

(3) Similar works have been also reported in other publications.

Although the aforesaid attempts have achieved some success, there is a continuing requirement of large thickness products of 7xxx aluminum alloys having better over-all properties and exhibiting more homogeneous properties inside of the products with the rapid development of modern aerial manufacturing and other relevant technologies. Thus, persons of skill in the art do not draw in the reins in this regard. Surprisingly, 7xxx series aluminum alloys would satisfy the aforesaid rigorous requirements if the content range of each component and the percentage of each element thereof are optimized more carefully.

SUMMARY OF THE PRESENT INVENTION

The first technical problem to be solved by the present invention is to provide aluminum alloy product for manufacturing structural components, which allow large thickness products made from 7xxx series aluminum alloys to exhibit a more superior combination of strength with damage tolerance properties, and allow the products to have more homogeneous performance on the surface, at the site of various under the surface, and in the core of the alloy product.

The second technical problem to be solved by the present invention is to provide a method of producing the deformed products of the aluminum alloys of the present invention.

The third technical problem to be solved by the present invention is to provide a method of producing the cast products of the aluminum alloys of the present invention.

The fourth technical problem to be solved by the present invention is to provide a novel product formed by welding the aluminum alloy product of the present invention with another product made from the same or other alloy material.

The fifth technical problem to be solved by the present invention is to provide the final components produced by handling the aluminum alloy products of the present invention through mechanical machining, chemical milling machining, electric discharge machining, or laser machining operation.

The sixth technical problem to be solved by the present invention is to provide the application of the final components of the present invention.

To achieve the above-described objects, the present invention utilizes the following technical solutions.

The present invention is directed to an aluminum alloy product for manufacturing structural components, said aluminum alloy products are produced through direct chill (DC) casting ingots and comprising the composition of, based on wt %, Zn 7.5-8.7, Mg 1.1-2.3, Cu 0.5-1.9, Zr 0.03-0.20, the balance being Al, incidental elements and impurities, wherein the levels of Zn, Mg, Cu, and Zr satisfy the following expressions: (a) 10.5≤Zn+Mg+Cu≤11.0; (b) 5.3≤(Zn/Mg)+Cu≤6.0; and (c) (0.24−D/4800)≤Zr≤(0.24−D/5000), wherein D is the minimum length of a line section connecting any two points on the periphery of the cross section of the ingot and passing through the geometrical center of the cross section, and 250 mm≤D≤1000 mm. On the one hand, the cast ingot may be round, and D may be the diameter of cross section thereof; and on the other hand, the cast ingot may be flat, and D may be the short side length of the cross section thereof.

In the first preferable embodiment of the present invention, the aluminum alloy product for manufacturing structural components comprise the composition of, based on wt %, Zn 7.5-8.4, Mg 1.65-1.8, Cu 0.7-1.5, Zr 0.03-0.20, the balance being Al, incidental elements and impurities, wherein the levels of Zn, Mg, Cu, and Zr satisfy the following expressions:

$$10.6 \le Zn+Mg+Cu \le 10.8; \quad (a)$$

$$5.5 \le (Zn/Mg)+Cu \le 5.7; \text{ and} \quad (b)$$

$$(0.24-D/4800) \le Zr \le (0.24-D/5000). \quad (c)$$

In a preferable aspect, the aluminum alloy product for manufacturing structural components have a Mg level of 1.69-1.8 wt %.

In the second preferable embodiment, the present invention, the aluminum alloy products further comprise at least one incidental microalloying element selected from the group consisting of Mn, Sc, Er and Hf, with the proviso that the levels of the microalloying elements satisfy the following expression: (0.24−D/4800)≤(Zr+Mn+Sc+Er+Hf)≤(0.24−D/5000).

In the third preferable embodiment of the present invention, the aluminum alloy products further comprise: Fe≤0.50 wt %, Si≤0.50 wt %, Ti≤0.10 wt %, and/or other impurity elements each ≤0.08 wt %, and total ≤0.25 wt %.

In the fourth preferable embodiment of the present invention, the aluminum alloy products comprise: Fe≤0.12 wt %, Si≤0.10 wt %, Ti≤0.06 wt %, and/or other impurity elements each ≤0.05 wt %, and total ≤0.15 wt %.

In the fifth preferable embodiment of the present invention, the aluminum alloy products comprise: Fe≤0.05 wt %, Si≤0.03 wt %, Ti≤0.04 wt %, and/or other impurity elements each ≤0.03 wt %, and total ≤0.10 wt %.

In the sixth preferable embodiment of the present invention, the Cu level in the aluminum alloy products is not greater that the Mg level.

In the seventh preferable embodiment of the present invention, the aluminum alloy products have a maximum thickness of the cross section of 250-360 mm, and a Cu level of 0.5-1.45 wt %.

The eighth preferable embodiment of the present invention, the aluminum alloy products have a maximum thickness of the cross section of 250-360 mm, and a Cu level of 0.5-1.40 wt %.

In the ninth preferable embodiment of the present invention, the aluminum alloy products have a maximum thickness of the cross section of 30-360 mm, and the aluminum alloy products are forged products, plate products, extrusion products, or cast products.

In the tenth preferable embodiment of the present invention, the aluminum alloy products have a maximum thickness of the cross section of 30-80 mm, and the aluminum alloy products are forged products, plate products, extrusion products, or cast products.

In the eleventh preferable embodiment of the present invention, the aluminum alloy products have a maximum thickness of the cross section of 80-120 mm, and the aluminum alloy products are forged products, plate products, extrusion products, or cast products.

In the twelfth preferable embodiment of the present invention, the aluminum alloy products have a maximum thickness of the cross section of 120-250 mm, and the aluminum alloy products are forged products, plate products, extrusion products, or cast products.

In the thirteenth preferable embodiment of the present invention, the aluminum alloy products have a maximum thickness of the cross section of 250-360 mm, and the aluminum alloy products are forged products, plate products, extrusion products, or cast products.

The present invention is further directed to a method of producing aluminum alloy products. The aluminum alloy products may comprise deformed products and cast products of aluminum alloys. The method of producing the deformed products of aluminum alloys may be described as "preparation and melting of alloys—DC casting ingots (round or flat ingots)—homogenization treatment of the ingots and surface finishing machining—hot working of the ingots (rolling of plates, forging of forgings, and extrusion of sectional bars/pipes/bars) to form the final product shape—solution heat treatment and stress-relief treatment—aging treatment—the final products". The method of producing the cast products of aluminum alloys may be described as "preparation and melting of alloys—casting—solution heat treatment—aging treatment—final products".

The process of the deformation processing of aluminum alloys may comprise:

1) producing the DC cast ingots of the present invention;

2) homogenizing the obtained ingots;

3) hot working the homogenized ingots one or more times to produce the desired alloy products;

4) solution heat treating the deformed alloy products;

5) rapidly cooling the solution heat treated alloy products to room temperature; and 6) aging the cooled alloy products for enhancing the strength and toughness so as to produce the desired deformed alloy products.

In step 1), the DC cast ingots are produced by the steps of melting, degasification, removal of inclusion, and DC casting, wherein the elements are accurately controlled during melting by using Cu which is hard to be burned loss as a core element; and each alloying elements is rapidly supplied and adjusted by on-line analyzing the level of each element so as to complete the process of producing the cast ingots. In a preferable aspect, the step 1) further comprises applying an electromagnetic stirring, ultrasonic stirring, or mechanical stirring at the site of or near the crystallizer.

In step 2), the homogenization treatment is carried out by means selected from the group consisting of: (1) single-stage homogenization treatment at a temperature ranging from 450 to 480° C. for 12-48 h; (2) two-stage homogenization treatment at a temperature ranging from 420 to 490° C. for total 12-48 h; and (3) multi-stage homogenization treatment at a temperature ranging 420 to 490° C. for total 12-48 h.

In step 3), the one or more deformation processing procedures are carried out by means selected from the group consisting of forging, rolling, extruding, and any combination thereof. Prior to each deformation procedure, the ingots are pre-heated to a temperature ranging from 380 to 450° C. for 1-6 h. In a preferable aspect, the ingots are hot deformed by means of free forging in combination with rolling, and the resultant plate products of alloy have a thickness of 120-360 mm.

In step 4), the solution heat treatment is carried out by means selected from the group consisting of: (1) single-stage solution heat treatment at a temperature ranging from 450 to 480° C. for 1-12 h; (2) two-stage solution heat treatment at a temperature ranging from 420 to 490° C. for total 1-12 h; and (3) multi-stage solution heat treatment at a temperature ranging from 420 to 490° C. for total 1-12 h. In a preferable aspect, the alloy products are solution heat treated at a temperature ranging 467 to 475° C. for an effective isothermal heating time of $$t(\text{min}) = 45(\text{min}) + \frac{d(\text{mm})}{2(\text{mm/min})},$$

wherein d is the maximum thickness of the aluminum alloy products.

In step 5), the alloy products are rapidly cooled to room temperature by means selected from the group consisting of immersion quenching in cooling medium, roller-hearth type spray quenching, forced-air cooling, and any combination thereof. In a preferable aspect, water is selected as the cooling medium for immersion quenching.

In step 6), the alloy products are aged by means selected from the group consisting of: (1) single-stage aging treatment (preferably, T6 peak aging treatment) at a temperature ranging 110 to 125° C. for 8-36 h; (2) two-stage aging treatment (preferably, T7 over-aging treatment), wherein the first stage aging treatment is carried out at a temperature of 110-115° C. for 6-15 h, and the second stage aging treatment is carried out at a temperature of 155-160° C. for 6-24 h; and (3) three-stage aging treatment, wherein the first stage aging treatment is carried out at a temperature of 105-125° C. for 1-24 h, the second stage aging treatment is carried out at a temperature of 170-200° C. for 0.5-8 h, and the three-stage aging treatment is carried out at a temperature of 105-125° C. for 1-36 h.

In a preferable aspect, the process of the present invention can further comprise the following step between steps 5) and 6): pre-deforming the cooled alloy products with the total deformation in the range of 1-5% so as to eliminate effectively the residual internal stress. In a preferable aspect, the pre-deforming treatment is pre-stretching; and in another preferable aspect, the pre-deforming treatment is pre-compression.

The present invention further provides a method of producing aluminum alloy cast products comprising the steps of:

1) producing cast ingots as described in the present invention;

2) solution heat treating the resultant cast ingots; and 3) aging the solution heat treated cast ingots to produce the desired alloy cast products.

In step 1), the cast ingots are produced by means of melting, degasification, removal of inclusion, and casting, wherein the elements are accurately controlled during melting by using Cu which is hard to be burned loss as a core element; and each alloying elements is rapidly supplied and adjusted by on-line analyzing the level of each element so as to complete the process of producing the cast ingots; and wherein the casting is selected from the group consisting of sand-casting, die-casting, and low pressure casting with or without mechanical stirring. Alternatively, in step 1), the cast ingots are produced by means of melting, degasification, removal of inclusion, and stirring to form blanks having semi-solid tissue features, which are reheated and subject to an additional low-pressure casting procedure so as to complete the production of the cast ingots, wherein the elements are accurately controlled during melting by using Cu which is hard to be burned loss as a core element; and each alloying elements is rapidly supplied and adjusted by on-line analyzing the level of each element so as to complete the process of producing the cast ingots; wherein the stirring is selected from the group consisting of electromagnetic stirring, mechanical stirring, and any combination thereof.

In step 2), the solution heat treatment are carried out by means selected from the group consisting of: (1) single-stage solution heat treatment at a temperature ranging from 450 to 480° C. for 1-48 h; (2) two-stage solution heat treatment at a temperature ranging from 420 to 490° C. for total 1-48 h; and (3) multi-stage solution heat treatment at a temperature ranging from 420 to 490° C. for total 1-48 h.

In step 3), the aging treatment is carried out by means selected from the group consisting of: (1) single-stage aging treatment (preferably, T6 peak aging treatment) at a temperature of 110-125° C. for 8-36 h; (2) two-stage aging treatment (preferably, T7 over-aging treatment), wherein the first stage aging treatment is carried out at a temperature of 110-115° C. for 6-15 h, and the second stage aging treatment is carried out at a temperature of 155-160° C. for 6-24 h; and (3) three-stage aging treatment, wherein the first stage aging treatment is carried out at a temperature of 105-125° C. for 1-24 h, the second stage aging treatment is carried out at a temperature of 170-200° C. for 0.5-8 h, and the third stage aging treatment is carried out at a temperature of 105-125° C. for 1-36 h.

Among others, the yield strengths on the surface, at the site of various depth under the surface, and in the core of the aluminum alloy products according to the present invention or produced according to the method of the present invention, exhibit a difference of 10% or less, preferably 6% or less, further preferably 4% or less.

In one aspect, the aluminum alloy products according to the present invention or produced according to the method of the present invention can be welded together with a material selected from the group consisting of the same or different alloy materials to form a novel product, wherein the welding is selected from the group consisting of friction stirring welding, melting welding, soldering/brazing, electron beam welding, laser welding, and any combination thereof.

In another aspect, the aluminum alloy products according to the present invention or produced according to the method of the present invention can be processed by means selected from the group consisting of mechanical machining, chemical milling machining, electric discharge machining, laser machining operation, and any combination thereof, to form final components selected from the group consisting of aircraft parts, vehicle parts, space crafts, and forming die. In a preferable aspect, the aircraft parts are selected from the group consisting of wing spar, built-up components of wing and body, force bearing frames, and wallboards of aircrafts. In another preferable aspect, the forming die is one for the production of formed products at a temperature of below 100° C. In still another preferable aspect, the vehicle parts are selected from the group consisting of automobile parts and railcar parts.

Hereinafter, the present invention is further described in details.

(1) As for products having a thickness ranging from 30 to 360 mm, the basic alloys as used in the present invention comprises, based on wt %, Zn 7.5-8.7, Mg 1.1-2.3, Cu 0.5-1.9, Zr 0.03-0.20, the balance being Al, incidental elements and impurities; wherein the levels of Zn, Mg, Cu, and Zr satisfy the expressions of (a) $10.5 \leq Zn+Mg+Cu \leq 11.0$, (b) $5.3 \leq (Zn/Mg)+Cu \leq 6.0$, and (c) $(0.24-D/4800) \leq Zr \leq (0.24-D/5000)$, wherein D is the minimum length of a line section connecting any two points on the periphery of the cross section of the cast ingot and passing through the geometrical center of the cross section, and $250\ mm \leq D \leq 1000\ mm$.

(2) Regarding products having a thickness of 30-360 mm, the more preferable basic alloys of the present invention comprise, based on wt %, Zn 7.5-8.4, Mg 1.65-1.8, Cu 0.7-1.5, Zr 0.03-0.20, the balance being Al, incidental elements and impurities; wherein the levels of Zn, Mg, Cu, and Zr satisfy the expressions of (a) $10.6 \leq Zn+Mg+Cu \leq 10.8$, (b) $5.5 \leq (Zn/Mg)+Cu \leq 5.7$, (c) $(0.24-D/4800) \leq Zr \leq (0.24-D/5000)$, wherein D is the minimum length of a line section connecting any two points on the periphery of the cross section of the cast ingot and passing through the geometrical center of the cross section, and $250\ mm \leq D \leq 1000\ mm$.

(3) The alloys of the present invention do not comprise microalloying elements Cr, V, or the like, which are commonly used in 7xxx series aluminum alloys. In addition to the element Zr added into the alloys of the present invention and the element Ti entrained by grain refiner into the alloys of the present application during the procedure of casting, the alloys of the present invention can further comprise microalloying elements Mn, Sc, Er, Hf, and the like. However, these microalloying elements, either introduced alone or in combination, still need to satisfy the expression of $(0.24-D/4800) \leq (Zr+Mn+Sc+Er+Hf) \leq (0.24-D/5000)$, to ensure that no or less primary precipitated phase containing the aforesaid elements is formed in the core of large size ingot which is cooled and solidified at a relatively low rate, wherein D is the minimum length of a line section connecting any two points on the periphery of the cross section of the cast ingot and passing through the geometrical center of the cross section, and 250 mm≤D≤1000 mm.

(4) When the alloys of the present invention are used for the production of deformed products and cast products, the levels of impurities and additional elements entrained by grain refiner should be controlled to satisfy the following expressions: Fe≤0.50 wt %, Si≤0.50 wt %, Ti≤0.10 wt %, and other impurities or incidental elements each ≤0.08 wt %, total ≤0.25 wt %; preferably, Fe≤0.12 wt %, Si≤0.10 wt %, Ti≤0.06 wt %, other impurities or incidental elements each ≤0.05 wt %, total ≤0.15 wt %; more preferably, Fe≤0.05 wt %, Si≤0.03 wt %, Ti≤0.04 wt %, other impurities or incidental elements each ≤0.03 wt %, total ≤0.10 wt %;

(5) In a further preferable embodiment, to avoid the stability decrease of supersaturated solid solution due to the low quench-cooling rate of the core of large thickness products, the upper limit of Cu level is not greater than 1.45 wt % if the 7xxx series aluminum alloy products have a thickness of up to 250 mm or greater.

(6) In a more preferable embodiment, to avoid the stability of supersaturated solid solution decreased due to the low quench-cooling rate of the core of large thickness products, the upper limit of Cu level is not greater than 1.40 wt % if the 7xxx series aluminum alloy products have a thickness of up to 250 mm or greater.

(7) The alloys of the present invention may be formed to cast ingots by means of melting, degasification, removal of inclusion, and DC casting. It should be specified that the elements should be accurately controlled during melting by using Cu which is hard to be burned loss as a core element; and each alloying elements should be rapidly supplied and adjusted by on-line analyzing the level of each element so as to complete the process of producing the cast ingots.

(8) The alloys of the present invention may also be formed to cast ingots by means of melting, degasification, removal of inclusion, and stirring (electromagnetic stirring, sonic field stirring, or mechanical stirring) at or around the site of crystallizer, so as to improve the shape of solid-liquid interface and reduce the depth of melt liquid cave during the solidification process of the alloys, and to crush effectively dendrite structure and decrease macroscopical and microscopical segregation of alloying elements. Meanwhile, oxide inclusions in the alloys should be controlled within the level range as well known in the art.

(9) The alloys of the present invention can be homogenized under the following conditions: single-stage homogenization treatment at a temperature of 450-480° C. for 12-48 h, or two-stage, even multi-stage homogenization treatment at a temperature of 420-490° C. for total 12-48 h.

(10) The alloys of the present invention can be subject to one or more hot deformation procedures by means of one or more deformation processing procedures selected from the group consisting of forging, rolling, and extruding, so as to form products with the desired size. The alloys may be pre-heated at a temperature of 380-450° C. for 1-6 h prior to each hot deforming procedure.

(11) In a further preferable embodiment, when the rolled plate products made from the alloys of the present invention have a thickness of up to 120 mm or greater, it is preferable to hot deform the alloys by means of free forging in combination with rolling to obtain sufficiently deformed structure in the core of the plate products. The alloys may be pre-heated at a temperature of 380-450° C. for 1-6 h prior to each hot deforming procedure.

(12) The alloys of the present invention can be solution heat treated under the following conditions: single-stage solution heat treatment at a temperature of 450-480° C. for 1-12 h, or two-stage or multi-stage solution heat treatment at a temperature of 420-490° C. for total 1-12 h.

(13) In a further preferable embodiment, it is preferable to solution heat treat the alloys of the present invention at a temperature of 467-475° C. for an effective isothermal heating time of $$t(\text{min}) = 45(\text{min}) + \frac{d(\text{mm})}{2(\text{mm/min})},$$

wherein d is the thickness (mm) of 7xxx series aluminum alloy products.

(14) The alloys of the present invention may be subject to water- or cooling medium-immersion quenching, or roller-hearth type spray quenching, or forced-air cooling, such that the solution heat treated alloy products can be rapidly cooled to room temperature.

(15) The residual internal stress of the present invention can be effectively eliminated by means of pre-stretching thick plate/sectional bar products or pre-compressing forgings. The total deformation of pre-stretching or pre-compression should be controlled in the range of 1-5%.

(16) The alloys of the present invention can be aged for enhancing the strength and toughness by means of single-stage aging process (e.g., T6 peak aging process), or two-stage aging process (e.g., T7 over-aging process, including T73, T74, T76, and T79 processes, etc.). Specially, if T6 peak aging process is used, the aging treatment can be carried out at a temperature of 90-138° C. for 1-48 h, preferably at a temperature of 100-135° C. for 1-48 h, and more preferably at a temperature of 110-125° C. for 8-36 h. If T7 over-aging process is used, the first stage aging treatment can be carried out at a temperature of 105-125° C. for 1-24 h, and the second stage aging treatment can be carried at a temperature of 150-170° C. for 1-36 h; preferably, the first stage is carried out at a temperature of 108-120° C. for 5-20 h, and the second stage is carried out at a temperature of 153-165° C. for 5-30 h; and more preferably, the first stage is carried out at a temperature of 110-115° C. for 6-15 h, and the second stage is carried out at a temperature of 155-160° C. for 6-24 h.

(17) The alloys of the present invention can be heat treated for enhancing the strength and toughness by means of three-stage aging process. Specially, the first stage aging treatment can be carried out at a temperature of 105-125° C. for 1-24 h, the second stage can be carried out at a temperature of 170-200° C. for 0.5-8 h, and the third stage can be carried out at a temperature of 105-125° C. for 1-36 h.

(18) When producing cast products, the alloys of the present invention may be formed to cast ingots by melting, degasification, removal of inclusions, and casting (sand-casting, die-casting, or low-pressure casting with or without mechanical stirring). It should be specified that the elements are accurately controlled during melting by using Cu which is hard to be burned loss as a core element; and each alloying elements is rapidly supplied and adjusted by on-line analyzing the level of each element so as to complete the process of producing the cast ingots.

(19) When producing cast products, the alloys of the present invention may be formed to cast ingots by means of melting, degasification, removal of inclusion, and stirring to form blanks having semi-solid tissue features, which are reheated and subject to an additional low-pressure casting procedure so as to complete the production of the cast ingots, wherein the elements are accurately controlled during melting by using Cu which is hard to be burned loss as a core element; and each alloying elements is rapidly supplied and adjusted by on-line analyzing the level of each element so as to complete the process of producing the cast ingots.

(20) The cast products made from the alloys of the present invention may be solution heat treated under the following conditions: single-stage solution heat treatment at a temperature of 450-480° C. for 1-48 h, or two-stage, or multi-stage solution heat treatment at a temperature of 420-490° C. for total 1-48 h.

(21) The alloys of the present invention can be subject to aging treatment for strengthening and toughness by means of T6 peak aging process or T7 over-aging process including T73, T74, T76, T79, or the like. Specially, if T6 peak aging process is used, the aging treatment can be carried out at a temperature of 90-138° C. for 1-48 h, preferably at a temperature of 100-135° C. for 1-48 h, and more preferably at a temperature of 110-125° C. for 8-36 h. If T7 over-aging process is used, the first stage aging process can be carried out at a temperature of 105-125° C. for 1-24 h, and the second stage can be carried out at 150-170° C. for 1-36 h; preferably, the first stage is carried out at 108-120° C. for 5-20 h, and the second stage is carried out at 153-165° C. for 5-30 h; and more preferably, the first stage is carried out at 110-115° C. for 6-15 h, and the second stage is carried out at 155-160° C. for 6-24 h.

(22) The alloys of the present invention can be aged for enhancing the strength and toughness by means of three-stage aging process. Specially, the first stage aging treatment may be carried out at a temperature of 105-125° C. for 1-24 h, the second stage may be carried out at 170-200° C. for 0.5-8 h, and the third stage may be carried out at 105-125° C. for 1-36 h.

The present invention provides the following benefits.

The present invention enables large thickness products made from 7xxx series aluminum alloys to have a more superior combination of strength and damage tolerance, while enabling the alloy products to have more homogeneous and consistent performance on the surface, at various depths under the surface, and in the core of the products. Although the present invention is typically used for large thickness forging products and rolling plate products for producing main force-bearing aerospace structural components having a large section, it is also adapted for extrusion and cast products having a great thickness entirely or locally.

DETAILED DESCRIPTION OF THE PRESENT INVENTION

Example 1

Figure 4:
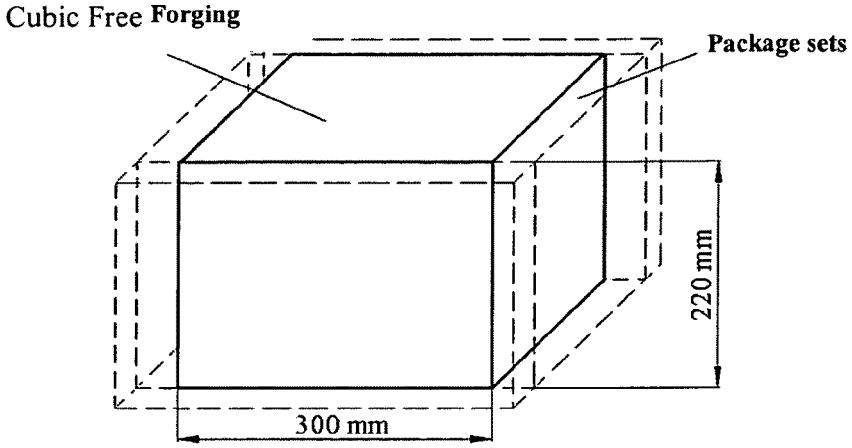
FIG. 4 is a schematic diagram indicating the package sets of laboratory small-size free forging product.

For proving the concept of the present invention, alloys were prepared in laboratory scale. The composition of the alloys were shown in Table 1. Round ingots having a diameter of 270 mm were prepared by well-known procedures including melting, degasification, removal of inclusion, and DC casting. The resultant ingots were homogenized under the conditions of (465±5° C./18 h)+(475±3° C./18 h), and then slowly air-cooled. The cooled ingots were peeled and sawed to form casting blanks of Φ250×600 mm. The casting blanks were pre-heated at 420±10° C. for 4 h, and then subject to all-round forge three times in a free forging machine. Finally, cubic free forging products having a dimension of 445 mm (length)×300 mm (width)×220 mm (thickness). For simulating practical industrial conditions of the quench-cooling of large size, large thickness forging products, these cubic free-forging products were packaged, as shown in FIG. 4 such that the heat conduction rate between the alloy products and ambience were effectively controlled via the selection of packaged materials having different heat conduction coefficient and the presence of interface between the package sets and the alloy products, and thereby the quench-cooling conditions of large size, large thickness forgings were simulated as soon as possible. All of these alloy products were subject to solution heat treatment, and immersion quenched in water at room temperature. Then, the alloy products were subject to aging treatment for enhancing the strength and toughness by T74 process. According the correlative testing standards, the alloys were measured for the ultimate tensile strength (UTS), tensile yield strength (TYS), elongation (EL), fracture toughness $K_{IC}$, stress corrosion cracking (SCC) resistance, and exfoliation corrosion (EXCO) property, etc. The results are shown in Table 2.

TABLE 1

Composition of the Alloy Ingots Prepared in Laboratory

| No. | Alloys of Invention (YES/NO) | Zn (wt %) | Mg (wt %) | Cu (wt %) | Zr (wt %) | Level of Main Impurities (wt %) |
|---|---|---|---|---|---|---|
| 1 | YES | 7.51 | 1.79 | 1.49 | 0.12 | Fe = 0.05, Si = 0.03, Ti = 0.02 |
| 2 | YES | 7.61 | 1.79 | 1.40 | 0.12 | Fe = 0.05, Si = 0.03, Ti = 0.02 |
| 3 | YES | 7.90 | 1.72 | 1.03 | 0.12 | Fe = 0.05, Si = 0.03, Ti = 0.02 |
| 4 | YES | 8.28 | 1.71 | 0.81 | 0.12 | Fe = 0.05, Si = 0.03, Ti = 0.02 |
| 5 | YES | 8.39 | 1.70 | 0.70 | 0.12 | Fe = 0.05, Si = 0.03, Ti = 0.02 |
| 6 | YES | 8.25 | 1.65 | 0.70 | 0.12 | Fe = 0.05, Si = 0.03, Ti = 0.02 |
| 7 | NO | 7.20 | 1.71 | 1.29 | 0.12 | Fe = 0.05, Si = 0.03, Ti = 0.02 |
| 8 | NO | 8.40 | 1.98 | 1.29 | 0.12 | Fe = 0.05, Si = 0.03, Ti = 0.02 |
| 9 | NO | 8.19 | 1.50 | 1.08 | 0.12 | Fe = 0.05, Si = 0.03, Ti = 0.02 |
| 10 | NO | 6.37 | 2.28 | 2.21 | 0.12 | Fe = 0.15, Si = 0.03, Ti = 0.03 |
| 11 | NO | 6.59 | 2.31 | 2.19 | 0.12 | Fe = 0.09, Si = 0.05, Ti = 0.03 |
| 12 | NO | 8.03 | 2.07 | 2.31 | 0.12 | Fe = 0.08, Si = 0.05, Ti = 0.03 |
| 13 | NO | 7.41 | 1.49 | 1.62 | 0.12 | Fe = 0.06, Si = 0.05, Ti = 0.03 |
| 14 | NO | 7.52 | 1.79 | 1.48 | 0.25 | Fe = 0.05, Si = 0.03, Ti = 0.02 |

[NOTE]1:

Considering that in the practical industrial production, forging products having a thickness of 220 mm were generally produced by using round ingots having a higher diameter of 580-600 mm, the Zr level was reasonably selected as 0.12 wt %.

[NOTE]2:

$10^{\#}$, $11^{\#}$, $12^{\#}$, and $13^{\#}$ alloys had similar composition to those of AA7050, AA7150, AA7055, and AA7085 alloys, respectively; $7^{\#}$ alloy: (Zn + Mg + Cu) = 10.20; $8^{\#}$ alloy: (Zn + Mg + Cu) = 11.67; $9^{\#}$ alloy: (Zn/Mg) + Cu = 6.54; $14^{\#}$ alloy: Zr > (0.24-D/5000).

TABLE 2

Properties of Large Thickness Forgings Prepared in Laboratory (T74 Conditions)

| | | L | | | L-T | ST | | | S-T | SCC | |
|---|---|---|---|---|---|---|---|---|---|---|---|
| No. | Sampling Sites | UTS MPa | TYS MPa | EL % | $K_{IC}$ MPa · $m^{1/2}$ | UTS MPa | TYS MPa | | $K_{IC}$ MPa · $m^{1/2}$ | resistance ≥ day(s) | EXCO |
| 1 | d/15 | 536 | 513 | 13.8 | | 520 | 501 | 8.5 | | 30 | |
| | d/4 | 521 | 500 | 14.2 | | 510 | 492 | 8.1 | | 30 | |
| | d/2 | 520 | 502 | 14.3 | 41.1 | 508 | 490 | 9.2 | 27.1 | 30 | EA |
| 2 | d/15 | 532 | 511 | 13.6 | | 518 | 503 | 8.7 | | 30 | |
| | d/4 | 522 | 502 | 14.1 | | 508 | 494 | 8.3 | | 30 | |
| | d/2 | 517 | 500 | 14.2 | 40.3 | 506 | 491 | 8.9 | 27.3 | 30 | EA |
| 3 | d/15 | 537 | 516 | 13.3 | | 522 | 505 | 8.6 | | 30 | |
| | d/4 | 523 | 505 | 14.1 | | 513 | 494 | 8.1 | | 30 | |
| | d/2 | 519 | 503 | 14.3 | 40.8 | 504 | 490 | 8.9 | 26.9 | 30 | EA |
| 4 | d/15 | 538 | 516 | 13.3 | | 518 | 503 | 8.7 | | 30 | |
| | d/4 | 526 | 505 | 13.7 | | 507 | 491 | 8.3 | | 30 | |
| | d/2 | 523 | 507 | 14.5 | 41.3 | 505 | 493 | 8.6 | 26.8 | 30 | EB |
| 5 | d/15 | 530 | 512 | 13.1 | | 516 | 498 | 8.9 | | 30 | |
| | d/4 | 525 | 510 | 14.1 | | 503 | 492 | 8.5 | | 30 | |
| | d/2 | 522 | 504 | 14.0 | 40.7 | 506 | 495 | 8.4 | 27.2 | 30 | EB |
| 6 | d/15 | 528 | 514 | 13.3 | | 514 | 496 | 8.6 | | 30 | |
| | d/4 | 521 | 510 | 13.7 | | 502 | 492 | 8.7 | | 30 | |
| | d/2 | 519 | 506 | 14.0 | 40.2 | 503 | 496 | 8.8 | 26.2 | 30 | EB |
| 7 | d/15 | 500 | 476 | 13.6 | | | | | | 30 | |
| | d/4 | 487 | 465 | 13.4 | | | | | | 30 | |
| | d/2 | 483 | 464 | 13.3 | 41.5 | | | | | 30 | EA |
| 8 | d/15 | 550 | 528 | 11.3 | | | | | | 30 | |
| | d/4 | 516 | 492 | 11.5 | | | | | | 30 | |
| | d/2 | 510 | 488 | 11.7 | 34.4 | | | | | 30 | EB |
| 9 | d/15 | 517 | 502 | 10.8 | | | | | | 30 | |
| | d/4 | 508 | 488 | 10.3 | | | | | | 30 | |
| | d/2 | 505 | 482 | 9.6 | 34.2 | | | | | 30 | EB |
| 10 | d/15 | 540 | 515 | 11.8 | | | | | | 30 | |
| | d/4 | 493 | 462 | 9.2 | | | | | | 30 | |
| | d/2 | 471 | 434 | 8.8 | 27.8 | | | | | 30 | EB |
| 11 | d/15 | 545 | 519 | 12.6 | | | | | | 30 | |
| | d/4 | 510 | 472 | 11.7 | | | | | | 30 | |
| | d/2 | 487 | 450 | 10.6 | 30.1 | | | | | 30 | EB |
| 12 | d/15 | 565 | 540 | 9.2 | | | | | | 30 | |
| | d/4 | 493 | 481 | 8.2 | | | | | | 30 | |
| | d/2 | 466 | 443 | 7.7 | 26.4 | | | | | 30 | EB |
| 13 | d/15 | 515 | 502 | 12.3 | | | | | | 30 | |
| | d/4 | 500 | 481 | 12.9 | | | | | | 30 | |
| | d/2 | 497 | 473 | 13.0 | 37.6 | | | | | 30 | EA |

TABLE 2-continued

Properties of Large Thickness Forgings Prepared in Laboratory (T74 Conditions)

| | | L | | | L-T | ST | | S-T | SCC | |
|---|---|---|---|---|---|---|---|---|---|---|
| No. | Sampling Sites | UTS MPa | TYS MPa | EL % | $K_{IC}$ MPa · $m^{1/2}$ | UTS MPa | TYS MPa | $K_{IC}$ MPa · $m^{1/2}$ | resistance ≥ day(s) | EXCO |
| 14 | d/15 | 531 | 519 | 13.1 | | | | | 30 | |
| | d/4 | 511 | 492 | 12.3 | | | | | 30 | |
| | d/2 | 500 | 490 | 12.6 | 36.6 | | | | 30 | EA |

[NOTE]:
The SCC resistance was measured under the following conditions: the samples were loaded in 3.5 wt % NaCl solution, and the load was set as 75% TYS.

It could be seen from Table 2 that 1#, 2#, 3#, 4#, 5#, and 6# alloy products all exhibited the so-called "superior combination of various properties" and "low quench sensitivity"; the alloys exhibited good SCC resistance and EXCO resistance (not lower than EB); and could maintain the elongation of 13% or above and the fracture toughness of 40 MPa·$m^{1/2}$ or above (L-T) when the L-direction yield strength was not less than 500 Mpa, and maintain the elongation of 8% or above and the fracture toughness of 26 MPa·$m^{1/2}$ or above (S-T) when the L-direction yield strength was not less than 500 Mpa when the ST-direction yield strength was not less than 490 Mpa. From the sub-surface (at the depth of d/15, where the quench-cooling rate was relatively high) to the core (at the depth of d/2, where the quench-cooling rate was relatively low) of the product, 4#, 5#, and 6# alloy products exhibited a less change of yield strength compared to 1#, 2#, and 3# alloy products, indicating that alloys having a lower Cu level were more adapted for the manufacture of some products having an extremely large thickness (e.g., those having a thickness of 300 mm or above); whereas it should be noted that when the Cu level of the alloys decreased, the EXCO property would drop from the EA Grade of 1#, 2#, and 3# alloy to the EB Grade of 4#, 5#, and 6# alloys.

Also, it could be seen from Table 2 that 1#, 2#, 3#, 4#, 5#, 6#, 7#, 8#, 9#, 13#, 14# alloys had a relatively lower Cu level and exhibited a change of yield strength of less than 6% from the sub-surface to the core of the product when the Zn and Mg levels were in a certain range, representing a relatively good "low quench sensitivity" feature; whereas 10#, 11#, and 12# alloys had a relatively high Cu level (≥2.1 wt %) and exhibited a change of yield strength of more than 13%, even up to near 18% from the sub-surface to the core of the product, representing a "high quench sensitivity" feature. However, it is also noted that 7# alloy had a relatively low total level of main alloying elements Zn, Mg, and Cu, which exhibited an excellent fracture toughness, but a relatively remarkable decrease of strength; 8# alloy had a relatively high total level of main alloying elements Zn, Mg, and Cu, which exhibited a good strength, but a relatively remarkable decrease of fracture toughness; 9# alloy provided a test result indicating that an extremely high ratio of Zn/Mg could not further enhance the strength of the alloy, but result in a decrease of the fracture toughness of the alloy; 13# alloy had a greater Cu level and a lower Mg level compared to 1#, 2#, 3#, 4#, 5#, and 6# and Cu wt %≥Mg wt %, and it could be seen that from the sub-surface to the core for the product, the change of yield strength increased and the fracture toughness decreased; and 14# alloy provided a test result indicating that an excessive Zr addition would cause an increasing of the change of yield strength and a decrease of the fracture toughness from the sub-surface to the core of the product.

Example 2

Figure 5:
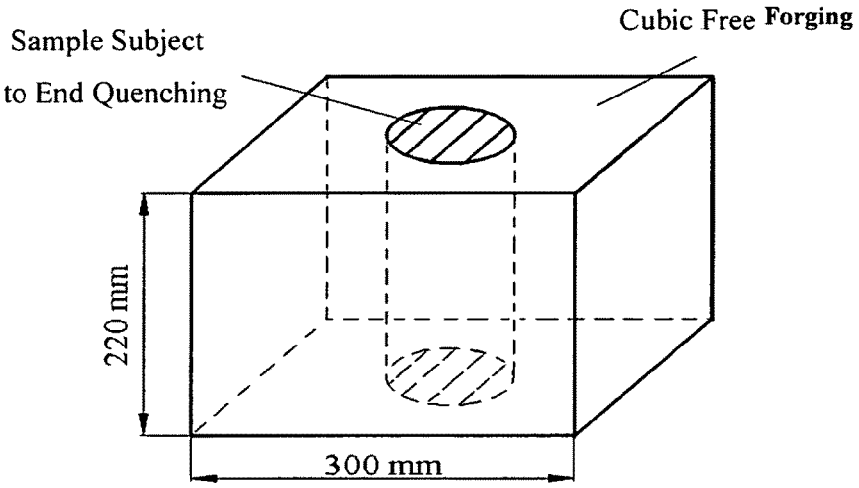
FIG. 5 is a schematic diagram indicating the sampling process of the Jominy end quench test sample.

The cubic free forging products of 1# and 10# alloys prepared in Example 1 were cut, along the height direction, to round bars having a dimension of Φ60×220 mm by means of electric spark processing, as shown in FIG. 5. The round bars were subject to Jominy End Quench Test.

Figure 6:
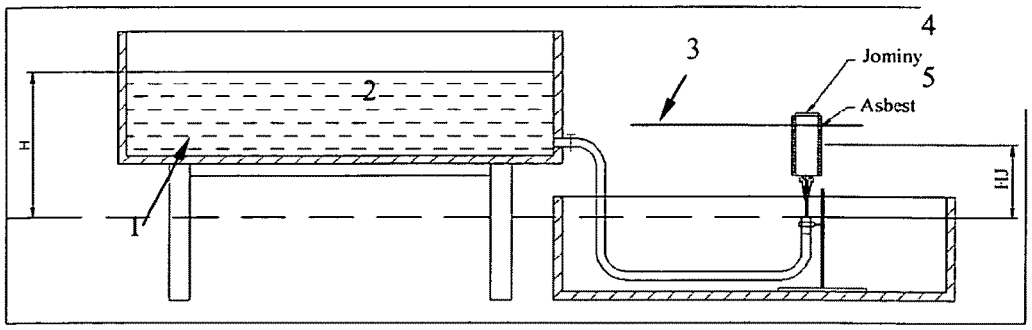
FIG. 6 shows a schematic diagram of test apparatus for the Jominy end quench test.

The end quench test was a conventional method for studying the quench sensitivity of materials. The test equipments were shown in FIG. 6 and described as below. A header tank 1 contained tap water 2 at 20□, and a water pipe 3 was connected to the lower portion of the header tank 1. The outlet of the water pipe 3 aligned with the lower portion of a round bar-like sample 4 for end quench, and the circumferential surface of the round bar is packed with heat-insulating materials 5 to reduce the interference of extraneous factors. One end surface of the round bar-like sample for end quench test sample 4 was subject to free spray quenching for about 10 min, and the parameter of ($H—H_J$) as shown in FIG. 6 represented the height of water storage in the header tank 1.

Figure 7:
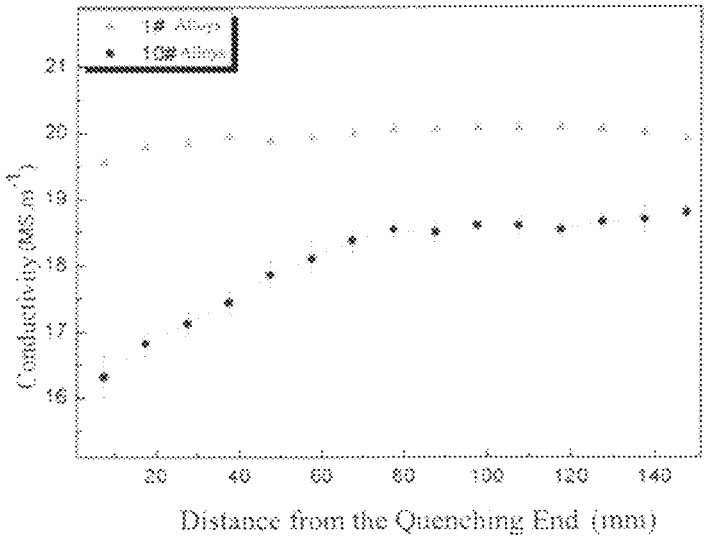
FIG. 7 shows a graph indicating the conductivity at various sites of the samples vs. distances from the quenching end after the end quench test.

As shown in FIG. 7, the curve marked with —▲— represented the electrical conductivity vs. the distance from the quenching end after the end quench test of 1# alloy; and the curve marked with —●— represented the electrical conductivity vs. the distance from the quenching end after the end quench test of 10# alloy.

It is well known that the electrical conductivity of alloys are associated with the degree of supersaturation of the alloy matrix obtained during the quenching process. In particular, the more the degree of supersaturation of the alloy matrix is, the more the lattice distortion is, the less the electrical conductivity of the alloy is, as the crystal lattice exhibits a higher barrier on the free electron scattering; in the contrast, the less the degree of supersaturation of the alloy matrix is, the less the lattice distortion is, the more the electrical conductivity of the alloy is.

As shown in FIG. 7, with the increasing of the distance from the quenching end, the quench cooling rate decreased continually—the electrical conductivity of 1# alloys were almost unchanged (the degree of supersaturation of the alloy matrix remained substantially unchanged), illustrating that the supersaturated solid solution throughout the alloy products was hardly decomposed, and had a low quench sensitivity; whereas the electrical conductivity of 10# alloy substantially increased (the supersaturation of alloy matrix decreased continually), indicating that with the continuing decrease of the quench cooling rate, the supersaturated solid solution of alloy was substantially decomposed, and had a relatively high quench sensitivity.

Example 3

An industrial trial was carried out by means of well known processes including melting, degasification, removal of inclusion, and DC casting, to produce a batch of round cast ingots having a diameter of 630 mm, and the composition of the ingots were shown in Table 3. The cast ingots were homogenized under the conditions of (465±5° C./24 h)+(475±3° C./24 h), and then slowly air-cooled. The cooled ingots were cut and sawed to form blanks of Φ600×1800 mm.

TABLE 3

Compositions of the Alloys Prepared in Industrial Trial

| Alloys of the present invention (Yes/No) | Zn (wt %) | Mg (wt %) | Cu (wt %) | Zr (wt %) | Level of Primary Impurities(wt %) |
|---|---|---|---|---|---|
| Yes | 7.63 | 1.79 | 1.38 | 0.11 | Fe = 0.06, Si = 0.05, Ti = 0.023 |

A blank was pre-heated at 420±10° C., and then subject to all-round forge three times in a free forging machine. Finally, a cubic free-forging product having a dimension of 2310 mm (length)×1000 mm (width)×220 mm (thickness) was prepared. The free-forging product was subject to solution heat treatment, and immersion quenched in water at room temperature. Then, the product was subject to cold pre-compression with the total deformation of 1-3% to eliminate the residual stress. The alloy product was subject to aging treatment for enhancing the strength and toughness by T76 or T74 procedures. According the correlative testing standards, the alloy was measured for the strength, elongation, fracture toughness, stress corrosion cracking resistance and exfoliation corrosion property. The results are shown in Table 4.

TABLE 4

Properties of Industrial Forging Having a Thickness of 220 mm

| Conditions of Thermal Treatment | Sampling Site | L UTS MPa | L TYS MPa | L EL % | L-T $K_{IC}$ MPa · $m^{1/2}$ | ST UTS MPa | ST TYS MPa | ST EL % | S-T $K_{IC}$ MPa · $m^{1/2}$ | SCC Resistance ≥ Days | EXCO |
|---|---|---|---|---|---|---|---|---|---|---|---|
| T76 | d/15 | 523 | 506 | 14.6 | | | | | | | |
| | d/4 | 509 | 487 | 14.7 | | | | | | | |
| | d/2 | 510 | 490 | 15.0 | 37.2 | 505 | 485 | 6.0 | 23.0 | 30 | EA |
| T74 | d/15 | 510 | 472 | 16.5 | | | | | | | |
| | d/4 | 501 | 463 | 16.0 | | | | | | | |
| | d/2 | 495 | 455 | 15.8 | 41.1 | 495 | 425 | 6.7 | 24.2 | 30 | EA |

[NOTE]:
The SCC resistance was measured under the following conditions: the samples were loaded in 3.5 wt % NaCl solution, and the load was set as 75% TYS.

It could be seen from Table 4 that the large thickness (220 mm) forging products prepared from the alloys of the present invention possessed the so-called "superior combination of various properties" and "low quench sensitivity". For instance, the alloy products, either under T76 condition or under T74 condition, had good SCC resistance and exfoliation corrosion properties, while the L-directional yield strength exhibited a change of less than 4% from the sub-surface to the core of the products. Under the T76 conditions, when the L-directional yield strength was not less than 490 MPa, the alloys could maintain the elongation of above 14% and the fracture toughness of above 37 MPa·$m^{1/2}$ (L-T); and when the ST-directional yield strength was not less than 480 MPa, the alloys could maintain the elongation of above 6% and the fracture toughness of above 23 MPa·$m^{1/2}$ (S-T). Under T74 condition, when the L-directional yield strength was not less than 450 MPa, the alloys could maintain the elongation of 15% or above and the fracture toughness of 41 MPa·$m^{1/2}$ or above (L-T); and when the ST-directional yield strength was not less than 420 MPa, the alloys could maintain the elongation of 6% or above and the fracture toughness of 24 MPa·$m^{1/2}$ or above (S-T). By adjusting the heat treatment conditions of the alloy, more and better over-all combination of various properties could be obtained.

Figure 8:
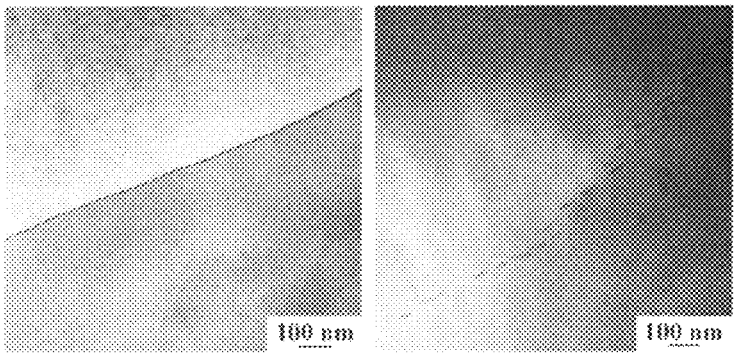
FIG. 8 shows TEM photographs at the site of ¼ thickness and in the core of a industrial forging having a thickness of 220 mm after quenching, wherein the left one is the TEM photograph at the site of ¼ thickness, and the right one is the TEM photographs of the core.

FIG. 8 shows the TEM phothgraphs at the ¼ depth and in the core of the products having a thickness of 220 mm made from the alloys of the present invention after quenching. It can be seen that at the ¼ depth of the forging product, no visible quench-precipitated phase was observed inside the matrix and on the grian boundary; and even in the core of the forging product where the quench cooling rate is slowest, there was no observable precipitated phase present inside the matrix, but only a small amount of fine, sheet-like η phase was found on the grain boundary. The above identified results further demonstrated, in the microstructure, the alloys of the present invention have a low quench sensitivity.

Example 4

A further industrial trial was carried out by means of well known procedures including melting, degasification, removal inclusion, and DC casting, to produce a batch of round cast ingots having a diameter of 980 mm. The composition of the ingots was shown in Table 5. The ingots were homogenized under the condition of (465±5° C./24 h)+(475±3° C./24 h), and then slowly air-cooled. The cooled ingots were peeled and sawed to form blanks of Φ950×1500 mm.

TABLE 5

Composition of the Alloys Prepared in Further Industrial Trial

| Alloys of the Present Invention (Yes/No) | Zn (wt %) | Mg (wt %) | Cu (wt %) | Zr (wt %) | Level of Main Impurities (wt %) |
|---|---|---|---|---|---|
| Yes | 7.60 | 1.78 | 1.39 | 0.04 | Fe = 0.04, Si = 0.06, Ti = 0.02 |

A blank was pre-heated at 420±10° C. for 6 h, and then subject to all-round forge three times in a free forging machine to form a cubic free-forging product having a dimension of 2950 mm (length)×1000 mm (width)×360 mm (thickness). The free-forging product was subject to solution heat treatment, immersion quenched in water at room temperature. Then, the product was subject to cold pre-compression with the total deformation of 1-3% to eliminate the residual stress. The alloy product was subject to aging treatment for enhancing the strength and toughness by T74 procedure. According the correlative testing standards, the alloy was measured for the strength, elongation, fracture toughness, stress corrosion cracking resistance and exfoliation corrosion property. The results are shown in Table 6.

TABLE 6

Properties of Industrial Forging Products Having a Thickness of 360 mm

| Thermal | | L | | | L-T | ST | | | S-T | SCC | |
|---|---|---|---|---|---|---|---|---|---|---|---|
| Treatment Conditions | Sampling Site | UTS MPa | TYS MPa | EL % | KIC MPa · $m^{1/2}$ | UTS MPa | TYS MPa | EL % | KIC MPa · $m^{1/2}$ | Resistance ≥ Days | EXCO |
| T74 | d/15 | 505 | 474 | 13.6 | | | | | | | |
| | d/4 | 497 | 463 | 14.1 | | | | | | | |
| | d/2 | 483 | 452 | 14.6 | 37.4 | 482 | 427 | 6.5 | 24.1 | 30 | EA |

[NOTE]:
The SCC resistance was measured under the following conditions: the samples were loaded in 3.5 wt % NaCl solution, and the load was set as 75% TYS.

It can be seen from Table 6 that the extremely large thickness (360 mm) forging products made from the alloys of the present invention possessed the so-called "superior combination of various properties" and "low quench sensitivity" feature. For instance, under T74 condition, the alloy products had a good SCC resistance and exfoliation corrosion properties, while the L-directional yield strength of the alloy exhibited a change of less than 6% from the subsurface to the core of the product. When the L-directional yield strength was not less than 450 MPa, the alloy could maintain the elongation of above 13% and the fracture toughness of above 37 MPa·$m^{1/2}$(L-T); and when the ST-directional yield strength was not less than 420 MPa, the alloy could maintain the elongation of above 6% and the fracture toughness of above 24 MPa·$m^{1/2}$(S-T). By adjusting the heat treatment conditions of the alloy, more and better over-all combination of various properties could be obtained.

Example 5

A blank prepared according to Example 4 was pre-heated at 420±10° C. for 6 h, and then subject to all-round forge three times in a free forging machine to form a cubic free forging product having a dimension of 2950 mm (length)×1000 mm (width)×360 mm (thickness). The forging product was further pre-heat at 410±10° C. for 3 h, and then subject to hot rolling to form a plate product of 6980 mm (length)×1000 mm (width)×152 mm (thickness). The thick plate was subject to solution heat treatment, cooled by means of water spray quenching at room temperature. Then, the plate was subject to cold pre-stretch with the total deformation of 1-3% to eliminate the residual stress. The alloy product was subject to aging treatment for enhancing the strength and toughness by T76, T74, or T73 procedure. According the correlative testing standards, the alloy was measured for the strength, elongation, fracture toughness, stress corrosion cracking resistance and exfoliation corrosion property. The results are shown in Table 7.

TABLE 7

Properties of Industrial Plate of 152 mm (Thickness)

| Thermal | | L | | | L-T | SCC | |
|---|---|---|---|---|---|---|---|
| Treatment Condition | Sampling Site | UTS MPa | TYS MPa | EL % | $K_{IC}$ MPa · $m^{1/2}$ | Resistance ≥ Days | EXCO |
| T76 | d/15 | 540 | 515 | 12.8 | | | |
| | d/4 | 531 | 506 | 12.1 | | | |
| | d/2 | 528 | 502 | 11.1 | 39.4 | 30 | EA |
| T74 | d/15 | 515 | 485 | 13.5 | | | |
| | d/4 | 505 | 474 | 13.1 | | | |
| | d/2 | 503 | 471 | 13.4 | 42.7 | 30 | EA |
| T73 | d/15 | 495 | 461 | 14.3 | | | |
| | d/4 | 487 | 453 | 13.7 | | | |
| | d/2 | 485 | 449 | 14.1 | 45.2 | 30 | EA |

[NOTE]:
The SCC resistance was measured under the following conditions: the samples were loaded in 3.5 wt % NaCl solution, and the load was set as 75% TYS.

Figure 1:
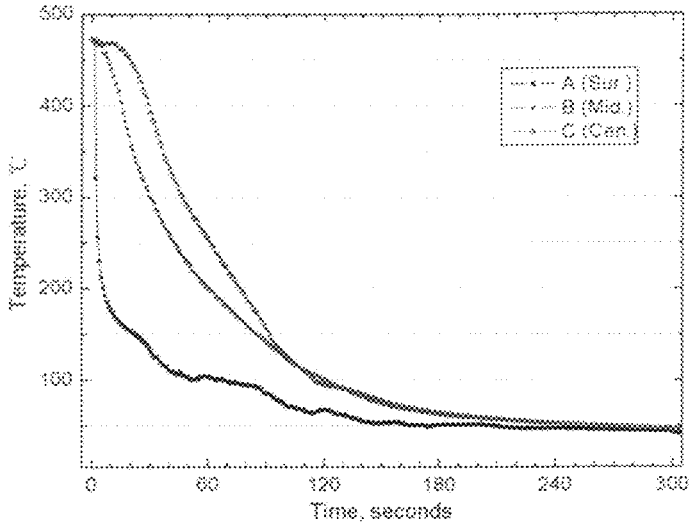
FIG. 1 shows a schematic diagram of the quench-cooling curve of large thickness product made from 7xxx series aluminum alloys.
Figure 2:
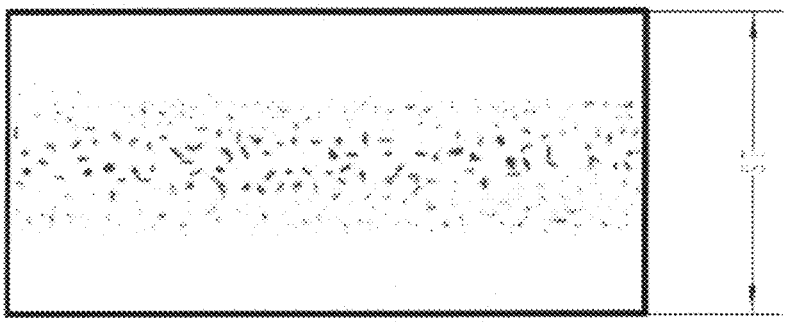
FIG. 2 shows a schematic diagram of dimension and distribution of the second phase formed by decomposition of supersaturated solid solution of alloys during the quenching procedure of large thickness product made from 7xxx series aluminum alloys.
Figure 3:
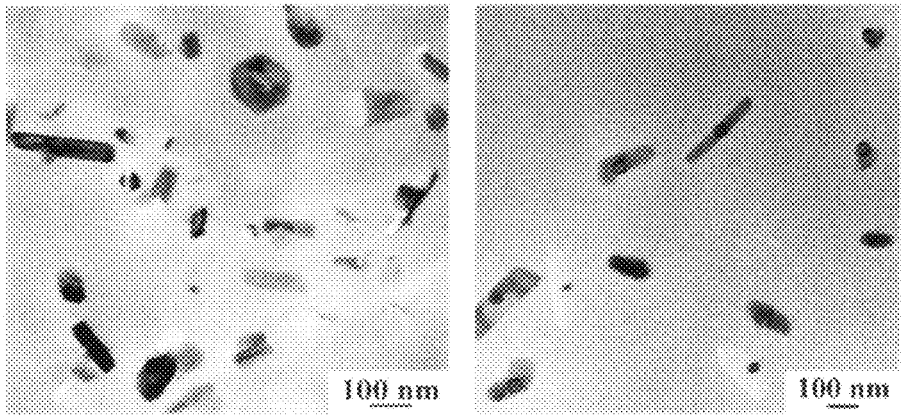
FIG. 3 shows TEM photographs indicating the preferential precipitation of quench-precipitated phase at the site of the second phase in a mismatching relation to the crystal lattice of the matrix during the quenching of the large thickness product made from 7xxx series aluminum alloys.
Figure 9:
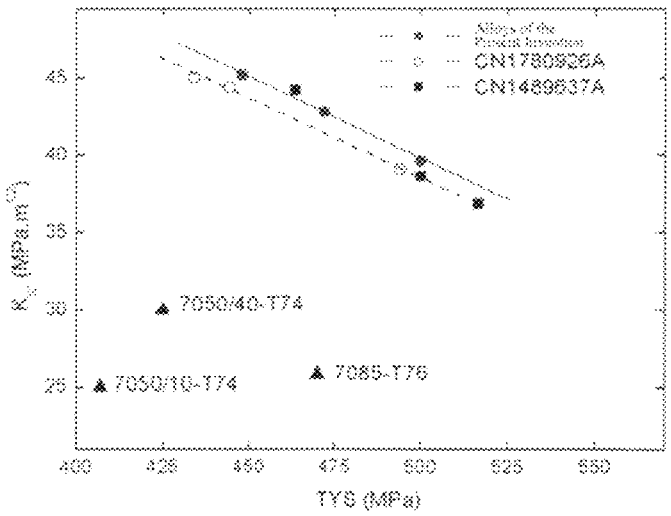
FIG. 9 compares the TYS-$K_{IC}$ property matching of the alloys of the present invention with several other reference alloys.

FIG. 9 compares the TYS-$K_{IC}$ property matching of the plate with a thickness of 152 mm of the present invention with the results as shown in FIG. 2 and Table 5 of CN1780926A, and the results as shown in Table 3 of CN1489637A, both of which were entirely incorporated herein by reference. The before-identified Chinese Patent Application which had been published provided examples (Example 3, Example 1). Although the composition of the aforesaid two alloys was different from those of the present invention, the alleged objects of them were to optimize the composition and proportion of the alloys for decreasing the quench sensitivity of the alloy materials. By comparison, it was found that the alloys of the present invention had TYS-$K_{IC}$ property matching similar to that of the aforesaid two references, but exhibited better elongation and TYS-EL-$K_{IC}$ three-property matching. FIG. 9 further provided the reprehensive property data of thick products made from AA7050/7010 alloy (see AIMS03-02-022, December, 2001), AA7050/7040 alloy (see AIMS03-02-019, September, 2001), and AA7085 alloy (see AIMS03-02-25, September, 2002) (typically, the minimal guaranteed properties).

Example 6

A industrial trial for the production of medium-thickness plate products was carried out by means of well known procedures including alloy melting, degasification, removal of inclusion, and DC casting, to produce a batch of flat ingots having a dimension of 1100 mm (width)×270 mm (thickness). The composition of the cast ingots was shown in FIG. 8. The cast ingots were homogenized under the conditions of (465±5° C./24 h)+(475±3° C./24 h), and then slowly air-cooled. The cooled ingots were subject to surface milling and sawing to form cubic blanks having a dimension of 1500 mm (length)×1100 mm (width)×250 mm (thickness).

TABLE 8

Composition of Industrial Medium-Thickness Plates

| Alloy of the Present Invention (Yes/No) | Zn (wt %) | Mg (wt %) | Cu (wt %) | Zr (wt %) | Levels of Main Impurities (wt %) |
|---|---|---|---|---|---|
| 是 | 7.52 | 1.78 | 1.47 | 0.19 | Fe = 0.06, Si = 0.05, Ti = 0.02 |

A cubic blank was pre-heated at 420±10° C. for 4 h, and then subject to hot rolling to form a medium-thickness plate product of 12500 mm (length)×1000 mm (width)×30 mm (thickness). The medium-thickness plate product was subject to solution heat treatment, cooled by means of water spray quenching at room temperature. Then, the plate was subject to cold pre-stretch with the total deformation of 1-3% to eliminate the residual stress. The alloy product was subject to aging treatment for enhancing the strength and toughness by T76, T74, or T77 procedure. According the correlative testing standards, the alloy was measured for the strength, elongation, fracture toughness, stress corrosion cracking resistance and exfoliation corrosion property. The results are shown in Table 8.

TABLE 9

Properties of Industrial Medium-Thickness Plates

| Thermal | L | | | L-T | | |
|---|---|---|---|---|---|---|
| Treatment Condition | UTS MPa | TYS MPa | EL % | $K_{IC}$ MPa · $m^{1/2}$ | Conductivity MS/m | EXCO |
| T74 | 530 | 505 | 18.0 | 80 | 24.1 | EA |
| T76 | 560 | 535 | 18.7 | 74 | 23.3 | EA |
| T77 | 575 | 555 | 16.7 | 67 | 23.1 | EA |

[NOTE]:
The $K_{IC}$ was only for reference because the requirement of $P_{max}/P_Q \leq 1.1$ was not satisfied, and the prefabricated fatigue cracks presented an unstable expansion phenomenon.

It can be seen from Table 9 that, compared with the results as shown in Table 6 of Example 4 of CN1780926A (the portions relating to the plate having a thickness of 30 mm), the alloys of the present invention exhibited a better TYS-EL-$K_{IC}$ three-property matching, that is to say, when the yield strength was similar, the alloys of the present invention would have remarkably improved elongation and fracture toughness properties.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

We claim:

1. An aluminum alloy product for manufacturing structural components, made from direct chill (DC) casting ingots, said alloy consisting essentially of, in weight % (wt %): Zn 7.5-8.7, Mg 1.65-1.8, Cu 0.5-1.9, Zr 0.03-0.20, the balance being Al, incidental elements and impurities, wherein the levels of Zn, Mg, Cu, and Zr satisfy the expressions of:

$$10.5 \leq Zn+Mg+Cu \leq 11.0; \quad (a)$$

$$5.3 \leq (Zn/Mg)+Cu \leq 6.0; \text{ and} \quad (b)$$

$$(0.24-D/4800) \leq Zr \leq (0.24-D/5000), \quad (c)$$

wherein D is the minimum length of a line section connecting any two points on the periphery of the cross section of the ingot and passing through the geometrical center of the cross section, and 250 nm≤D≤1000 mm.

2. The aluminum alloy products for manufacturing structural components according to claim 1, said alloy consisting of, in weight %: Zn 7.5-8.4, Mg 1.65-1.8, Cu 0.7-1.5, Zr 0.03-0.20, the balance being Al, incidental elements and impurities, wherein the levels of Zn, Mg, Cu, and Zr satisfy the expressions of:

$$10.6 \leq Zn+Mg+Cu \leq 10.8; \quad (a)$$

$$5.5 \leq (Zn/Mg)+Cu \leq 5.7; \text{ and} \quad (b)$$

$$(0.24-D/4800) \leq Zr \leq (0.24-D/5000). \quad (c)$$

3. The aluminum alloy products for manufacturing structural components according to claim 1, wherein in weight %, the level of Mg is 1.69-1.8.

4. The aluminum alloy products for manufacturing structural components according to claim 1, further comprising at least one incidental microalloying elements selected from the group consisting of Mn, Sc, Er, and Hf with the proviso that the levels of the microalloying element satisfy the expression of (0.24−D/4800)≤(Zr+Mn+Sc+Er+Hf)≤(0.24−D/5000).

5. The aluminum alloy products for manufacturing structural components according to claim 1, further comprising: Fe≤0.50 wt %, Si≤0.50 wt %, Ti≤0.10 wt %, and/or other impurity elements each ≤0.08 wt %, and total ≤0.25 wt %.

6. The aluminum alloy products for manufacturing structural components according to claim 1, wherein the Cu level is not greater than the Mg level.

7. The aluminum alloy products for manufacturing structural components according to claim 1, wherein the aluminum alloy products have a maximum thickness of the cross section of 250-360 mm, and said alloy contains, in weight %, a Cu level of 0.5-1.45.

8. The aluminum alloy products for manufacturing structural components according to claim 1, wherein the aluminum alloy products have a maximum thickness of the cross section of 30-360 mm, and the aluminum alloy products are selected from the group consisting of forged products, plate products, extrusion products, and cast products.

9. The aluminum alloy products for manufacturing structural components according to claim 1, wherein the ingots are selected from the group consisting of round and flat.

10. The aluminum alloy products according to claim 1, wherein the yield strengths on the surface, at the site of various depth under the surface, and in the core exhibit a difference of 10% or less.

11. The aluminum alloy products according to claim 1, wherein the aluminum alloy products are welded together with a material selected from the group consisting of the same or different alloy materials to form a novel product, wherein the welding is selected from the group consisting of friction stirring welding, melting welding, soldering/brazing, electron beam welding, laser welding, and any combination thereof.

12. The aluminum alloy products according to claim 1, wherein the aluminum alloy products are processed to final components by a step selected from the group consisting of mechanical machining, chemical milling machining, electric discharge machining, laser machining, and any combination thereof.

13. The aluminum alloy products according to claim 12, wherein the final components are selected from the group consisting of aircraft parts, vehicle parts, space crafts, and forming die.

14. An aluminum alloy product for manufacturing structural components, made from direct chill (DC) casting ingots, said alloy consisting essentially of, in weight % (wt %): Zn 7.5-8.7, Mg 1.65-1.8, Cu 0.5-1.9, Zr 0.03-0.20, the balance being Al, incidental elements and impurities, wherein the levels of Zn, Mg, Cu, and Zr satisfy at one time the expressions of:

$$10.5 \le Zn+Mg+Cu \le 11.0; \quad (a)$$

$$5.3 \le (Zn/Mg)+Cu \le 6.0; \text{ and} \quad (b)$$

$$(0.24-D/4800) \le Zr \le (0.24-D/5000), \quad (c)$$

wherein D is the minimum length of a line section connecting any two points on the periphery of the cross section of the ingot and passing through the geometrical center of the cross section, and 250 mm≤D≤1000 mm.

15. A method of producing deformed products of the aluminum alloy, comprising the steps of:

(1) DC casting an ingot according to claim 1;

(2) homogenizing the ingot after casting;

(3) hot working the homogenized ingots one or more times to form the alloy products having the desired dimension;

(4) solution heat treating the deformed alloy products;

(5) rapidly cooling the solution heat treated alloy products to room temperature; and (6) aging the alloy products for enhancing the strength and toughness, to achieve the desired alloy products.

16. The method according to claim 15, wherein in step 2) the homogenization treatment is carried out by a step selected from the group consisting of:

(1) single-stage homogenization treatment at a temperature ranging from 450 to 480° C. for 12-48 hours;

(2) two-stage homogenization treatment at a temperature ranging from 420 to 490° C. for total 12-48 hours; and (3) multi-stage homogenization treatment at a temperature ranging 420 to 490° C. for total 12-48 hours.

17. The method according to claim 15, wherein one or more deformation processing procedures are carried out by a step selected from the group consisting of forging, rolling, extruding, and any combination thereof; and prior to each deformation procedure, the ingots are pre-heated to a temperature ranging from 380 to 450° C. for 1-6 hours.

18. The method according to claim 15, wherein in step 4), the solution heat treatment is carried out by a step selected from the group consisting of:

(1) single-stage solution heat treatment at a temperature ranging from 450 to 480° C. for 1-12 hours;

(2) two-stage solution heat treatment at a temperature ranging from 420 to 490° C. for total 1-12 hours; and (3) multi-stage solution heat ea temperature ranging from 420 to 490° C. for total 1-12 hours, wherein the alloy products are solution heat treated at a temperature ranging 467 to 475° C. for an effective isothermal heating time of:

$$t(\text{min}) = 45(\text{min}) + \frac{d(\text{mm})}{2(\text{mm/min})},$$

wherein d is the maximum thickness of the aluminum alloy products.

19. The method according to claim 15, wherein in step 6) the alloy products are aged by means selected from the group consisting of:

(1) single-stage aging treatment (preferably, T6 peak aging treatment) at a temperature ranging 110 to 125° C. for 8-36 hours;

(2) two-stage aging treatment, wherein the first stage aging treatment is carried out at a temperature of 110-115° C. for 6-15 h, and the second stage aging treatment is carried out at a temperature of 155-160° C. for 6-24 hours; and (3) three-stage aging treatment, wherein the first stage aging treatment is carried out at a temperature of 105-125° C. for 1-24 hours, the second stage aging treatment is carried out at a temperature of 170-200° C. for 0.5-8 hours, and the three-stage aging treatment is carried out at a temperature of 105-125° C. for 1-36 hours.

20. The method according to claim 15, wherein in step 5) the alloy products are rapidly cooled to room temperature by a step selected from the group consisting of immersion quenching in cooling medium, roller-hearth type spray quenching, forced-air cooling, and any combination thereof; and wherein the method further comprises, between steps 5)

and 6), the step of pre-deforming the cooled alloy products with the total deformation in the range of 1-5% to eliminate effectively the residual internal stress.

21. A method of producing casting products of e aluminum alloys comprising the steps of:

(1) casting an ingot according to claim 1;

(2) solution heat treating the resultant ingots; and (3) aging the solution heat treated ingots to form the desired alloy casting products.

* * * * *